US009631349B2

(12) United States Patent
Petner

(10) Patent No.: US 9,631,349 B2
(45) Date of Patent: Apr. 25, 2017

(54) PLUNGER WITH TOILET DECLOGGER

(71) Applicant: Robert E. Petner, Burlington, NJ (US)

(72) Inventor: Robert E. Petner, Burlington, NJ (US)

( * ) Notice: Subject to any disclaimer, the term of this patent is extended or adjusted under 35 U.S.C. 154(b) by 134 days.

(21) Appl. No.: 14/798,509

(22) Filed: Jul. 14, 2015

(65) Prior Publication Data

US 2016/0017583 A1 Jan. 21, 2016

Related U.S. Application Data

(60) Provisional application No. 62/024,526, filed on Jul. 15, 2014.

(51) Int. Cl.
*E03D 11/00* (2006.01)
*E03C 1/308* (2006.01)

(52) U.S. Cl.
CPC ..... *E03C 1/308* (2013.01)

(58) Field of Classification Search
USPC ..... 4/255.04–255.12
See application file for complete search history.

(56) References Cited

U.S. PATENT DOCUMENTS 4,174,548 A * 11/1979 Dunn ..... E03F 9/005 15/104.33
2011/0056007 A1* 3/2011 Caywood ..... E03C 1/302 4/255.11

* cited by examiner

*Primary Examiner* — Lauren Crane
(74) *Attorney, Agent, or Firm* — Stuart M. Goldstein

(57) ABSTRACT

A toilet plunger has a hollow tube with a rotatable handle at one end and a bell shaped plunger member with a top opening secured at the other end. A helix shaped stem is connected to the handle and extends the length of the tube. The stem extends through the upper section of a declogger member which is positioned adjacent to the stem. Rotational turning of the handle causes the declogger member to travel down the stem, through the top opening and out the plunger member, to assist in unclogging stopped-up toilet drainage lines and the like. Reversing the rotation of the handle causes the declogging member to be withdrawn back into the tube, but not before it is scrapped clean by a wiper member protruding from the top opening, into the interior space of the plunger member.

8 Claims, 4 Drawing Sheets

FIG. 4
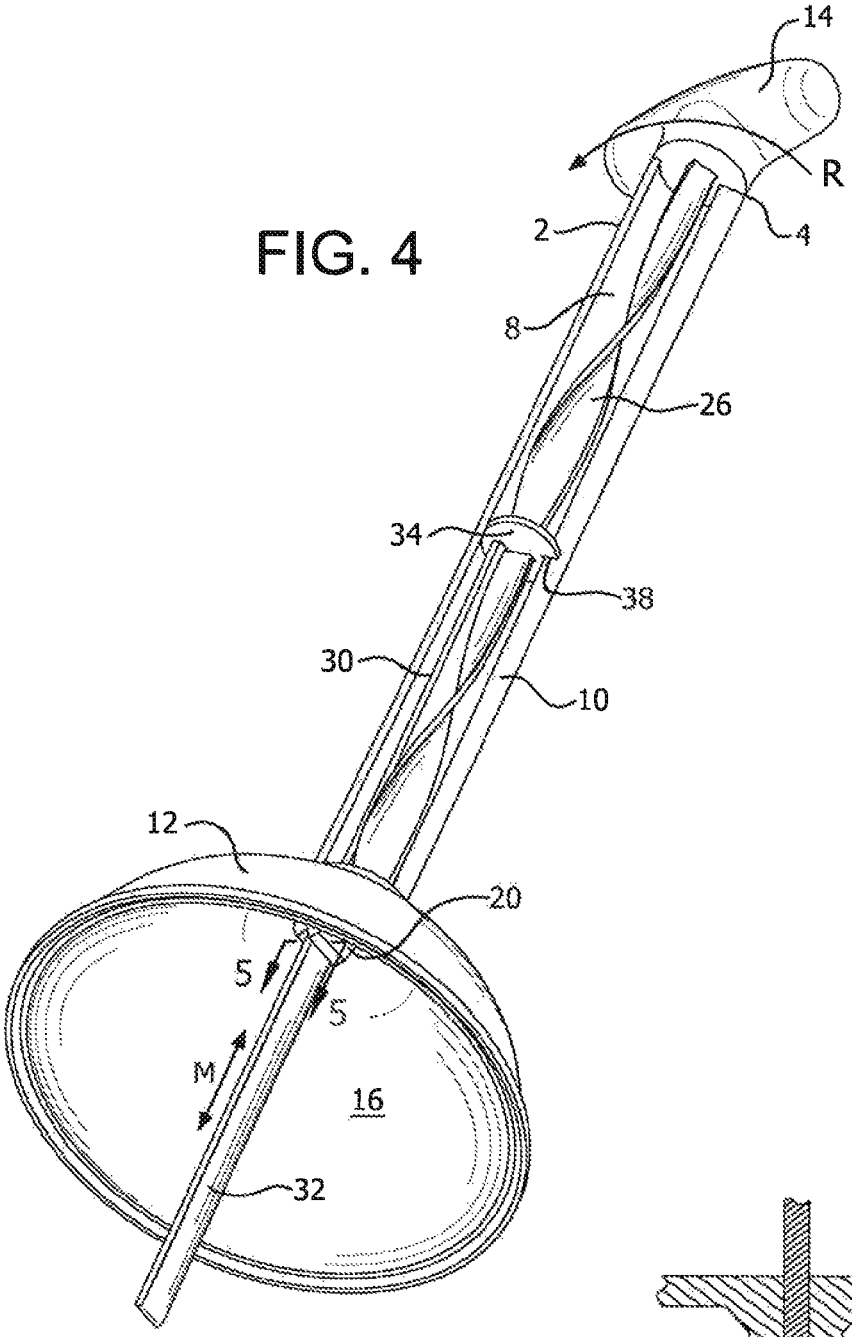
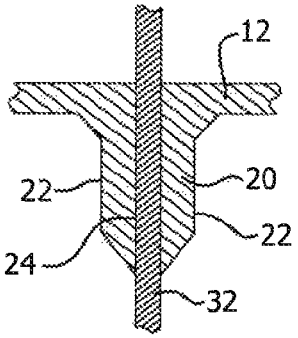
FIG. 5

PLUNGER WITH TOILET DECLOGGER

RELATED APPLICATION

This application claims the benefit of application Ser. No. 62/024,526, filed on Jul. 15, 2014.

BACKGROUND OF THE INVENTION

Plungers have long been used to unclog toilet piping, drainage pipes, and other fluid carrying lines which become obstructed with waste material and other semi-solid debris. However, conventional plungers rely on the suction force applied by their commonly used bell shaped plunger members to unclog and free debris from stopped up lines. Unfortunately, these plungers are ineffective when the obstructive material in the line is stuck or caked within the line or is heavier and otherwise resistant to the limited suction available with a plunger. There are currently no manually operated plungers which can easily and effectively clear a stopped-up toilet, sink, or tube drainage line, by other than the attempted use of mere suction.

SUMMARY OF THE INVENTION

It is thus the object of the present invention to overcome the limitations and disadvantages of existing manually operated plungers.

It is the object of the present invention to provide a plunger which utilizes both suction force and a declogging system to unclog toilet, sink, or tube drainage piping.

It is another object of the present invention to provide a plunger having an extendable declogging member which can be employed to unclog and remove solid, heavy, or caked on waste material and debris from stopped-up lines.

It is a further object of the present invention to provide a plunger which has a wiper member which scrapes off and cleans the plunger's declogging member after it is used.

These and other objects are accomplished by the present invention, a toilet plunger having a hollow tube with a rotatable handle at one end and a bell shaped plunger member with a top opening secured at the other end. A helix shaped stem is connected to the handle and extends the length of the tube. The stem extends through the upper section of a declogger member which is positioned adjacent to the stem. Rotational turning of the handle causes the declogger member to travel down the stem, through the top opening and out the plunger member, to assist in unclogging stopped-up toilet drainage lines and the like. Reversing the rotation of the handle causes the declogging member to be withdrawn back into the tube, but not before it is scrapped clean by a wiper member protruding from the top opening, into the interior space of the plunger member.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

BRIEF DESCRIPTION OF THE DRAWINGS

FIG. 4 is a cut-away, bottom perspective view of the plunger of the present invention, showing the declogger element extending through the bell of the plunger and the integral wiper member located at the top of the interior of the bell.

FIG. 5 is a cross-sectional view taken from FIG. 4.

DETAILED DESCRIPTION OF THE INVENTION

Figure 1:
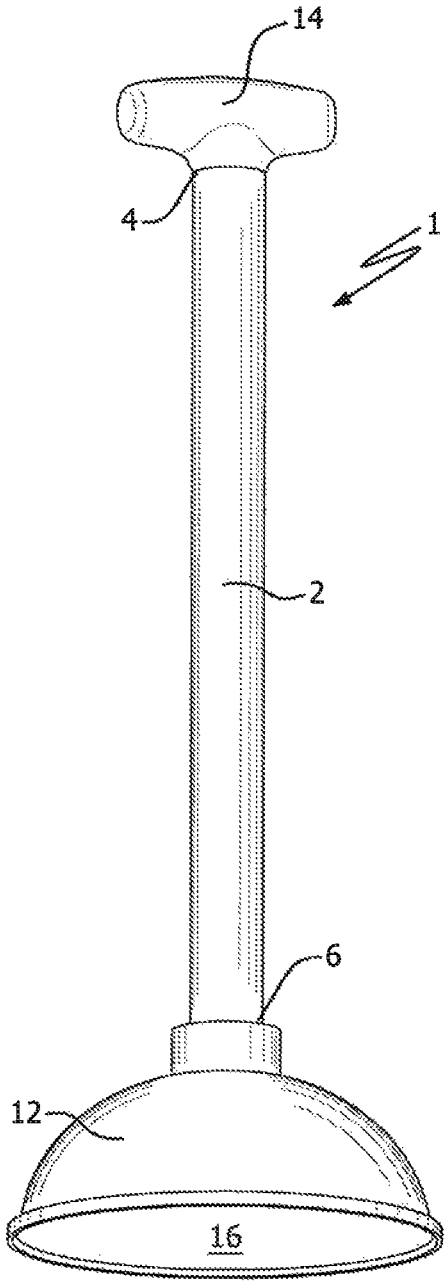
FIG. 1 is an elevation view of the plunger of the present invention.
Figure 2:
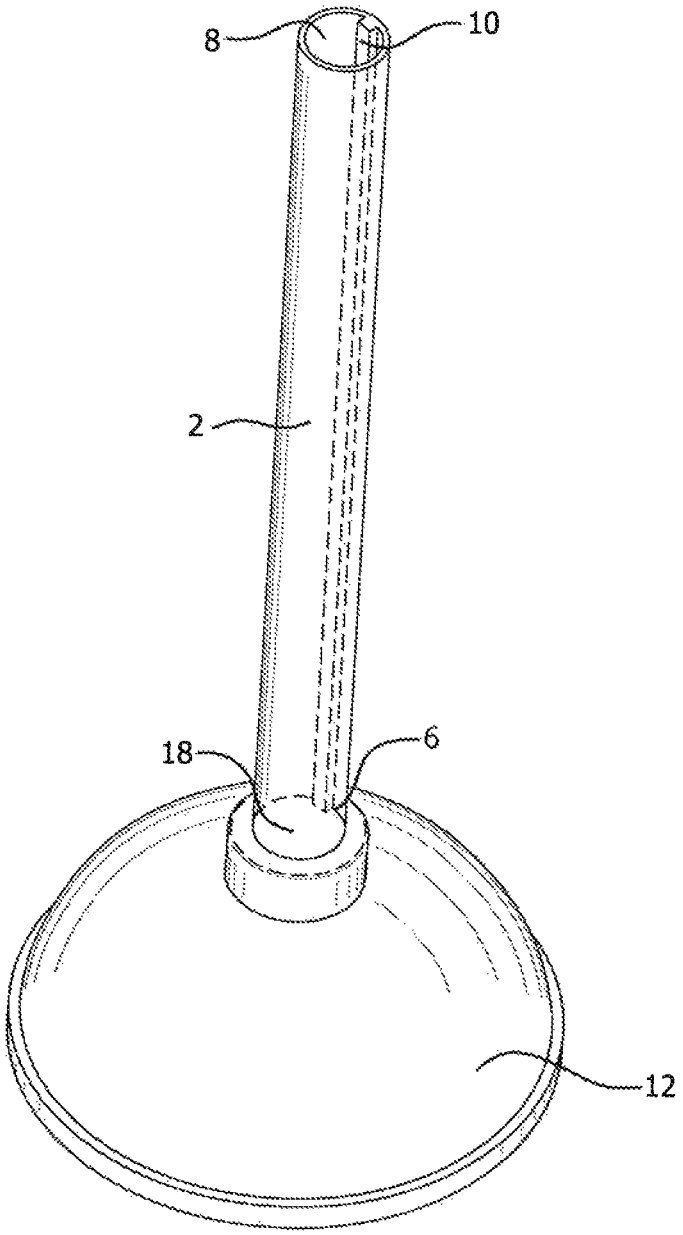
FIG. 2 is a partial, top perspective view of the plunger of the present invention, showing the positioning of the guide member.
Figure 3:
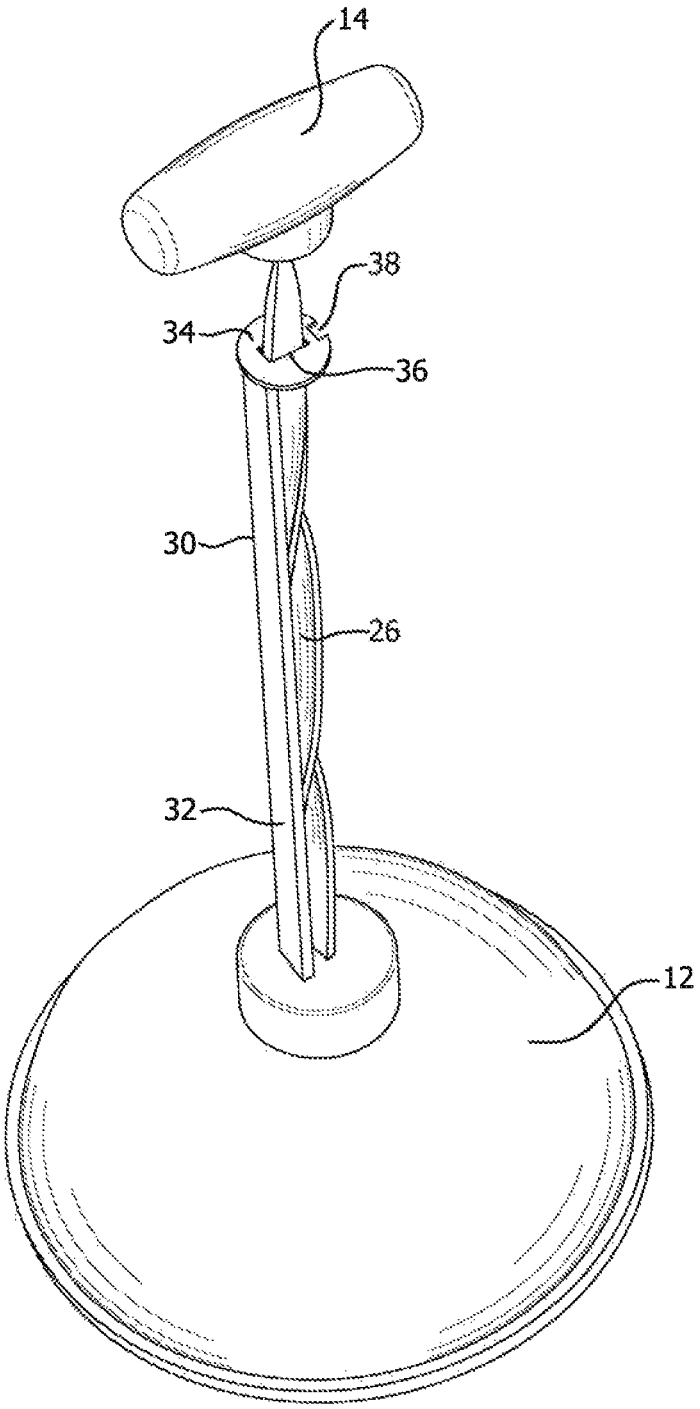
FIG. 3 is a partial, top perspective view of the plunger of the present invention, with its tube omitted and showing the declogger member mounted on the plunger helix stem.

Plunger 1 comprises elongated hollow tube 2 having upper end 4, lower end 6, and open through channel 8. Guide member 10 extends into channel 8 and runs along the entire length of tube 2. Bell shaped plunger member 12 is secured to lower end 6 of tube 2. Handle 14 is positioned at upper end 4 of tube 2 and is rotatable in relation to the tube.

Plunger member 12 comprises interior space 16. Top opening 18 extends through the upper section of plunger member 12. Lower end 6 of tube 2 is positioned over top opening 18, resulting in channel 8 being in vertical alignment with the top opening. This configuration provides a clear and straight open passage through tube 2, into top opening 18, and then to interior space 16.

Wiper member 20 protrudes from top opening 18, down into interior space 16. Wiper member 20 comprises bottom walls 22, the surfaces of which form wiper opening 24 therebetween.

Elongated helix shaped stem 26, connected to handle 14, is located within tube 2. When handle 14 is turned and rotated, stem 26 rotates along with the handle. Stem 26 is fabricated with a strong, but flexible material, e.g. rubber, a pliable plastic, or their equivalent.

Declogger member 30 is located within tube 2, adjacent to and extending along stem 26. Declogger member 30 comprises elongated declogger rod 32 and upper platform 34. Platform hole 36 extends through platform 34. Stem 26 extends through platform 34. Notch 38 is inset within platform 34. Guide member 10 is positioned within notch 38. Declogger member is fabricated with a rigid, unbendable material, such as hard plastic, or its equivalent.

In operation, plunger member 12 of plunger 1 is placed over a toilet, sink or tube drainage line. Handle 14 is rotated R, see FIG. 4, which in turn causes stem 26 to rotate. Since stem 26 passes through platform hole 36 of declogger platform 34 and declogger member 30 itself is prevented from rotating by the positioning of stationary guide member 10 within notch 38 of the declogger platform, the declogger is caused to travel down along stem 26. Continued rotation of handle 14 results in declogger rod 32 of declogger member 30 moving M through top opening 18 of plunger member 12, then into its interior space 16, and ultimately pushing through into the drainage line to unclog its line or piping.

When the unclogging process is completed, handle 14 is rotated in the opposite direction. This results in declogger rod 32 being retracted back towards interior space 6 of plunger member 12. Before declogger rod 32 is fully withdrawn from interior space 16, it contacts the surfaces of walls 22 of wiper member 20, which serves to scrape and clean off waste, dirt, and other material from the declogger rod, as the rod continues its movement through the wiper member. Once through wiper member 20, declogger rod is wiped substantially clean.

It is thus evident that the plunger of the present invention is unique in its ability to "push through" pipe clogs, caused by waste material and other semi-solid debris. The cleaning feature of the plunger, made possible by the movement of declogger rod 32 through wiper member 20, is an additional novel and useful feature of the invention.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A toilet plunger for clearing material from a toilet or sink drainage line, said plunger comprising:

an elongated tube comprising upper and lower ends, an open through channel, and a guide member extending into the channel and along the length of the tube;

a bell shaped plunger member secured to the lower end of the tube, said plunger member having an interior space and a top opening leading from the channel into the interior space;

a handle located at the upper end of the tube, said handle being rotatable in relation to the tube;

an elongated helix shaped stem located within and secured to the handle at the upper end of the tube, said stem being rotatable upon rotation of the handle; and a declogger member adjacent to and extending along the stem, said declogger member comprising an upper platform having a hole through which the stem extends, and a notch inset within the platform, the guide member being positioned within the notch, whereby rotation of the handle and the resulting rotation of the stem causes the declogger member to travel along the stem and through the top opening and into the interior space of the plunger member.

2. The toilet plunger as in claim 1 further comprising a wiper member extending from the top opening into the interior space, whereby the declogging member passes through the wiper member as it travels into and is withdrawn from the interior space of the plunger member.

3. The toilet plunger as in claim 2 whereby when the declogger member is withdrawn from the interior space, the wiper member scrapes and cleans drainage line material from the declogger member.

4. A toilet plunger for cleaning material from a toilet or sink drainage line, said plunger comprising:

an elongated tube comprising upper and lower ends, and an open through channel;

a bell shaped plunger member secured to the lower end of the tube, said plunger member having an interior space and a top opening leading from the channel into the interior space;

a handle located at the upper end of the tube, said handle being rotatable in relation to the tube;

an elongated stem located within and secured to the handle at the upper end of the tube, said stem being rotatable upon rotation of the handle; and a rigid, linearly straight declogger member adjacent and secured to and, at all times extending along the stem, whereby rotation of the handle and the resulting rotation of the stem, causes the declogger member to travel along the stem and through the top opening and into the interior space of the plunger member.

5. The toilet plunger as in claim 4 further comprising a wiper member extending from the top opening into the interior space, whereby the declogging member passes through the wiper member as it travels into and is withdrawn from the interior space of the plunger member.

6. The toilet plunger as in claim 5 whereby when the declogger member is withdrawn from the interior space, the wiper member scrapes and cleans drainage line material from the declogger member.

7. A toilet plunger for cleaning material from a toilet or sink drainage line, said plunger comprising:

an elongated tube comprising upper and lower ends, an open through channel, and a guide member extending into the channel and along the length of the tube;

a bell shaped plunger member secured to the lower end of the tube, said plunger member having an interior space and a top opening leading from the channel into the interior space;

a handle located at the upper end of the tube, said handle being rotatable in relation to the tube;

an elongated stem located within and secured to the handle at the upper end of the tube, said stem being rotatable upon rotation of the handle;

a rigid, linearly straight declogger member adjacent and secured to and, at all times extending along the stem within the tube; and a wiper member extending from the top opening into the interior space, whereby rotation of the handle and the resulting rotation of the stem, causes the declogger member travel along the stem and through the top opening and into the interior space of the plunger member, the declogger member passing through the wiper member as it travels into and is withdrawn from the interior space of the plunger member.

8. The toilet plunger as in claim 7 whereby when the declogger member is withdrawn from the interior space, the wiper member scrapes and cleans drainage line material from the declogger member.

* * * * *